US007862854B2

(12) United States Patent
Kerkar et al.

(10) Patent No.: US 7,862,854 B2
(45) Date of Patent: Jan. 4, 2011

(54) METHOD FOR PREPARING A PARTIALLY COATED ROOFING MEMBRANE

(75) Inventors: Awdhoot Vasant Kerkar, Rockaway, NJ (US); Vinay Mehta, Bridgewater, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 957 days.

(21) Appl. No.: 11/334,641

(22) Filed: Jan. 18, 2006

(65) Prior Publication Data

US 2007/0166499 A1 Jul. 19, 2007

(51) Int. Cl.
*B05D 5/10* (2006.01)

(52) U.S. Cl. ..... 427/207.1; 427/256; 428/167

(58) Field of Classification Search ..... 427/207.1, 427/256; 428/167
See application file for complete search history.

(56) References Cited

U.S. PATENT DOCUMENTS

2004/0157075 A1* 8/2004 Yang ..... 428/516
2005/0106360 A1* 5/2005 Johnston et al. ..... 428/167

* cited by examiner

*Primary Examiner*—Michael Kornakov
*Assistant Examiner*—Xiao Zhao
(74) *Attorney, Agent, or Firm*—William J. Davis; Sills Cummis & Caross

(57) ABSTRACT

A method for preparing a roofing membrane, and a membrane, having significantly less adhesive while retaining the same sealing properties. The reduction in the amount of adhesive significantly decreases the cost of raw materials needed for manufacturing the membrane and thus reduces the overall cost of the membrane itself.

9 Claims, 4 Drawing Sheets

METHOD FOR PREPARING A PARTIALLY COATED ROOFING MEMBRANE

FIELD OF THE INVENTION

The present invention relates to roofing products. More specifically, the invention relates to roofing products having waterproofing functionality and which are provided with a compound and/or adhesive thereon but which uses less compound or adhesive while remaining waterproof.

BACKGROUND

Adhesive or compound cost is a significant portion of total raw materials cost of most roofing products. Roofing products such as single-ply membranes are most often coated with one or more compounds and/or adhesives before being applied upon a roof surface. It is essential as well that the roofing products and the adhesives which bind the products to the roof surface provide a waterproof covering to prevent the seepage of rain or precipitation through the roof surfaces.

In order to create the most effective water-tight seal, roofing products such as single-ply membranes are generally completely coated on their undersurface for complete adherence to the roof deck substrate. Currently, most asphaltic or non-asphaltic peel-and-stick products used in the roofing industry are fully coated over the surface area that is intended to be adhered to a given surface. One exception includes membranes provided with straight or curvy stripes formed in the coating. However, this stripe coat leaves continuous channels which permits water to flow through and thus compromising the water sealing properties of the membrane.

SUMMARY OF THE INVENTION

The invention provides a method for preparing a roofing membrane which utilizes significantly less adhesive while retaining the same waterproofing or sealing properties as in the traditionally fully coated products. Also provided is a roofing membrane having significantly less adhesive thereon. The reduction in the amount of adhesive significantly decreases the cost of raw materials needed for manufacturing the membrane and thus reduces the overall cost of the membrane itself.

The above and other features of the invention, including various novel details of construction and composition, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE FIGURES

These and other features, aspects, and advantages of the apparatus and methods of the present invention will become better understood with regard to the following description, appended claims, and accompanying drawings where:

DETAILED DESCRIPTION

Figure 1:
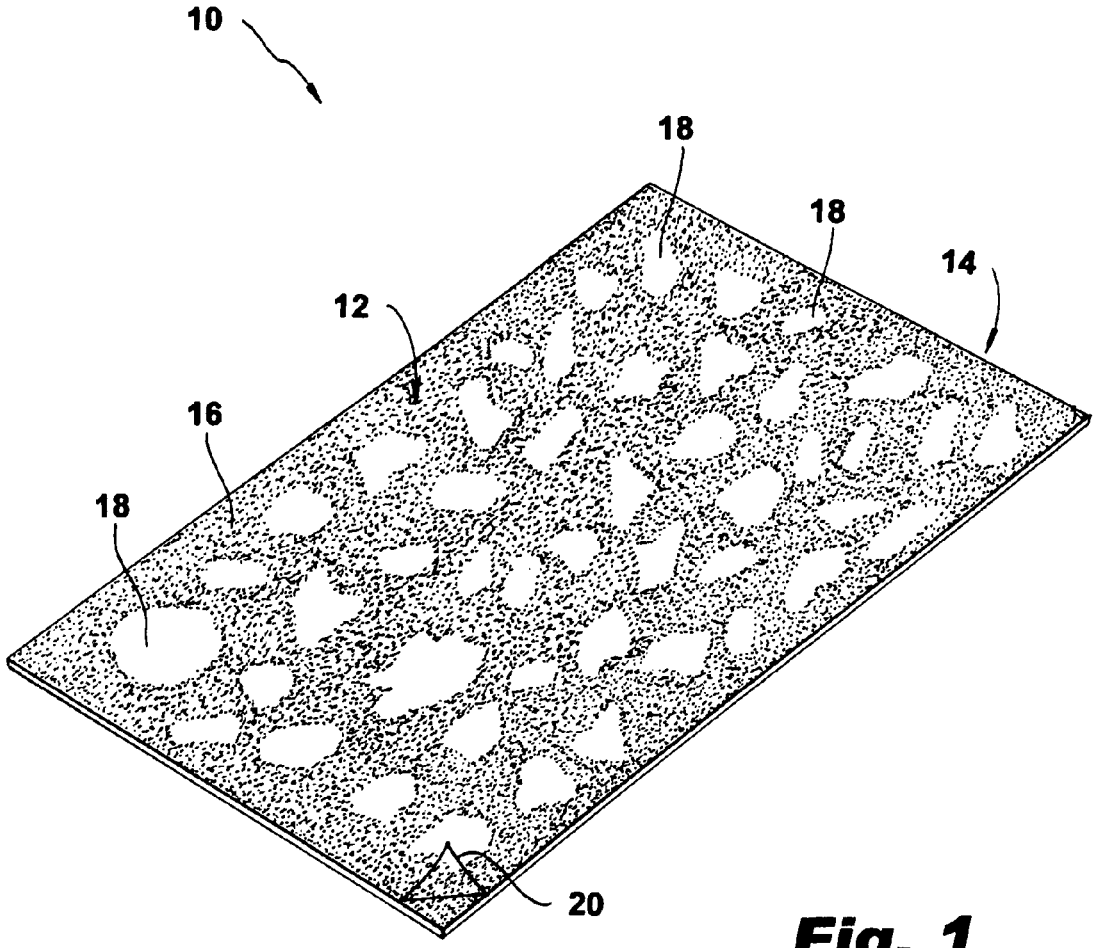
FIG. 1 is perspective view of a starve coated membrane in accordance with the present invention.

The puddle or starve coated peel-and-stick membrane 10 in accordance with the present invention is shown in a first embodiment in FIG. 1. Membrane 10 includes an upper or exposed adhesive surface 12 and a lower or substrate surface 14. An adhesive coating 16 which can include a chemical composition such as a sealant, primer, adhesive or the like, or a mixture thereof, is coated, sprayed or spread upon lower or substrate surface 14. In FIG. 1, numerous puddles 18 are randomly dispersed in adhesive coating 16 on substrate surface 14 of membrane 10. The puddles 18 in adhesive coating 16 allow for the use of less adhesive coating 16 thus resulting in a cost saving to the manufacturer and purchaser. In spite of the puddles 18, the membrane still completely adheres to the roofing surface and creates a watertight seal thereto such that membrane 10 provides for a substantially waterproof layer on the roof. After lower or substrate surface 14 of membrane 10 is coated, a release liner 20 is positioned on coating 16 to facilitate transit and storage of the membranes. To apply membrane 10 to a roof surface (not shown), release liner 20 is peeled away and the exposed coating 16 on upper surface 12 will adhere to the roof surface.

Figure 2:
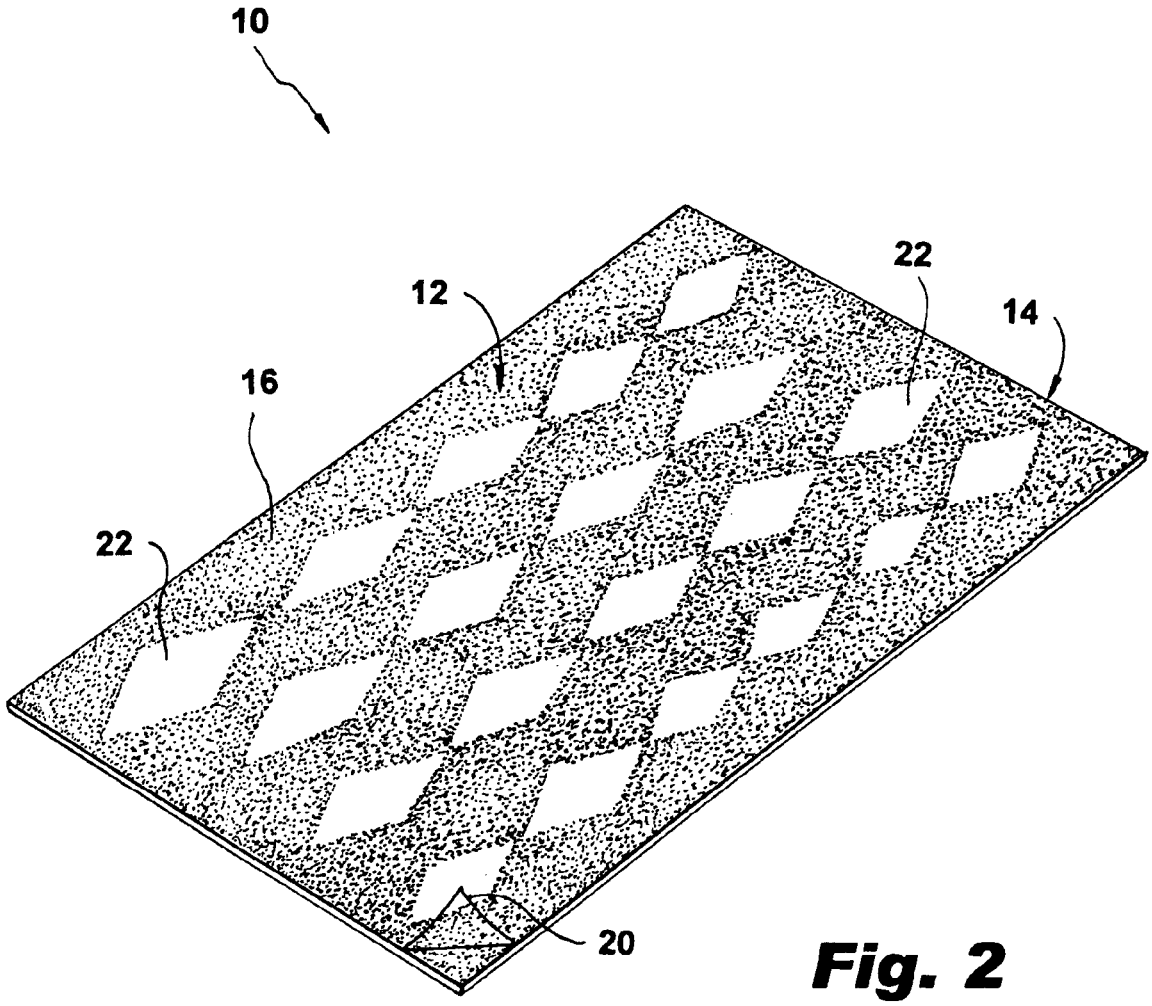
FIG. 2 is a perspective view of an alternative embodiment of a starve coated membrane in accordance with the present invention.
Figure 3:
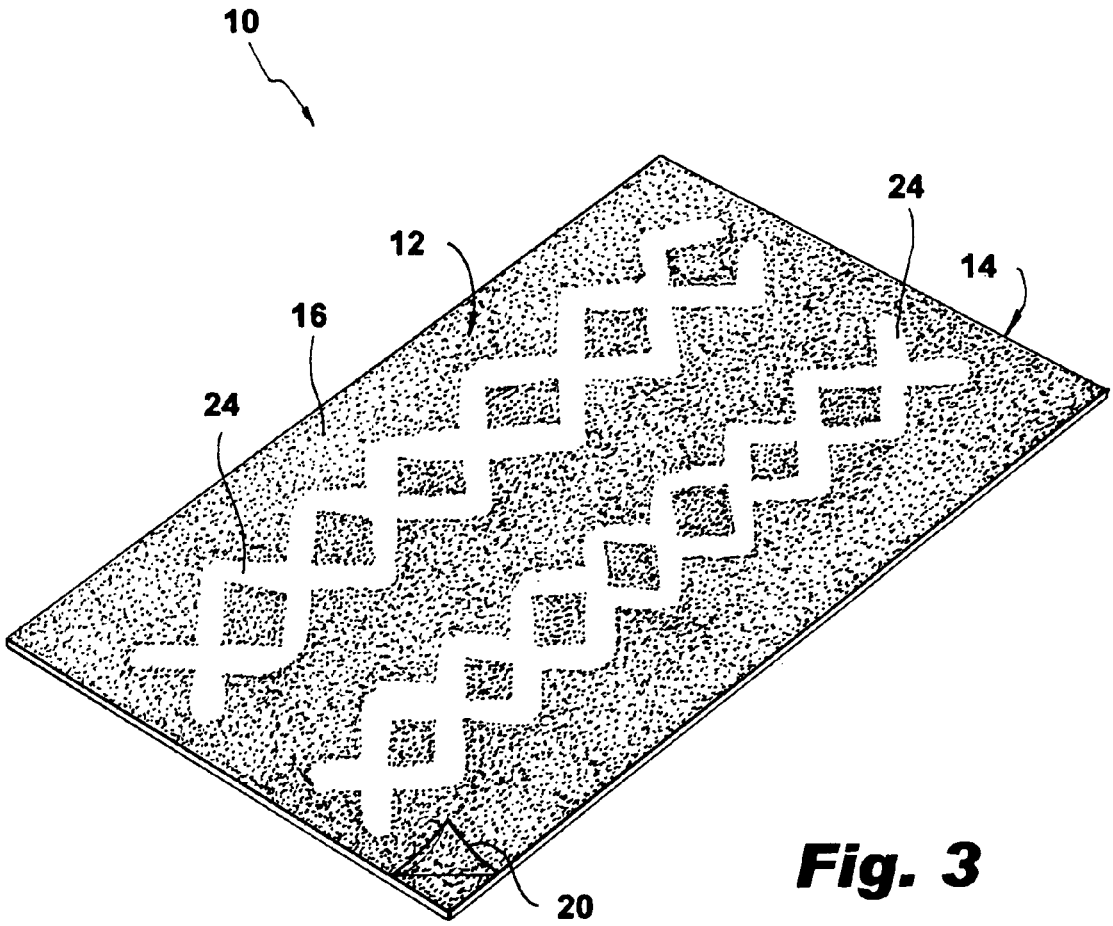
FIG. 3 is a perspective view of an alternative embodiment of a starve coated membrane in accordance with the present invention.
Figure 4:
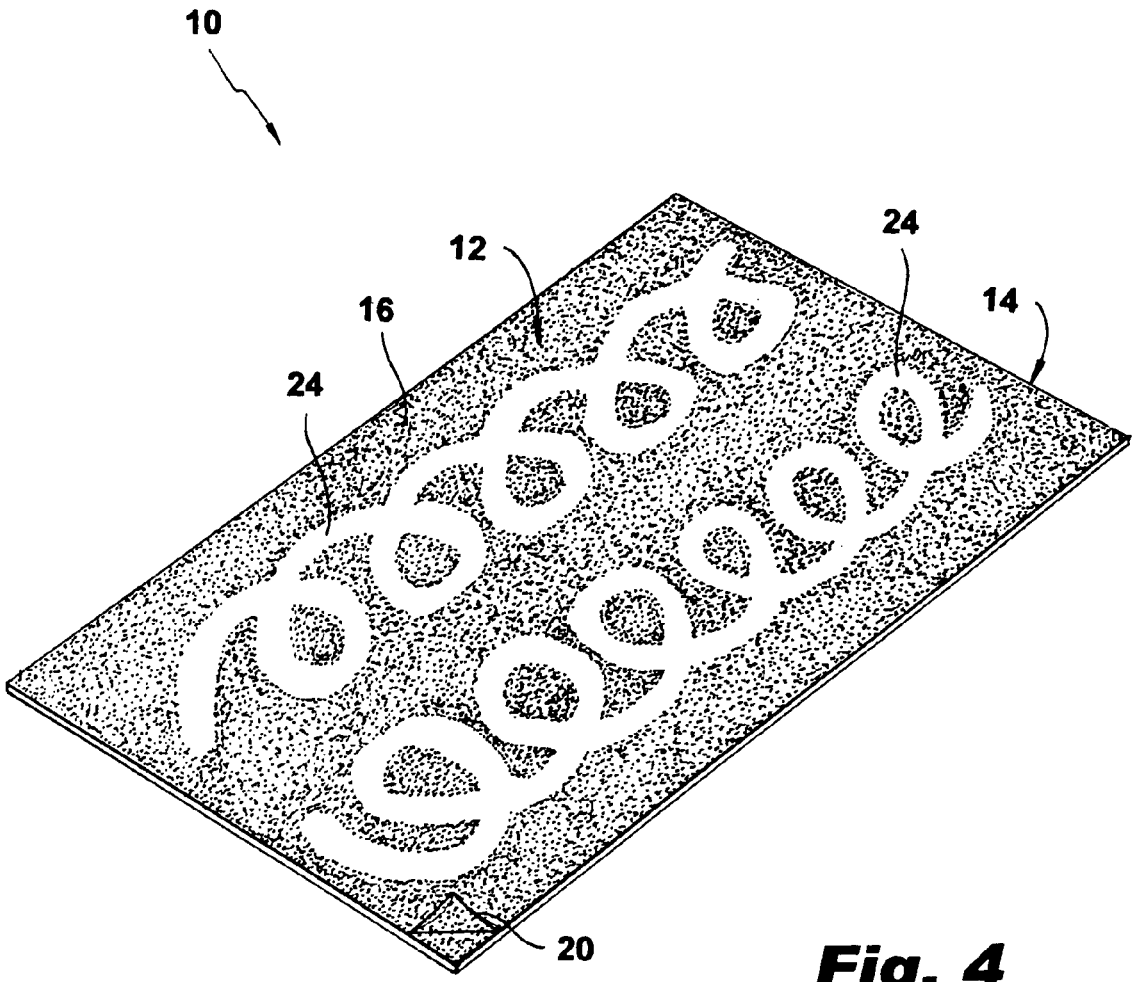
FIG. 4 perspective view of an alternative embodiment of a starve coated membrane in accordance with the present invention.

In alternative embodiments illustrated in FIGS. 2, 3 and 4, puddles 18 are shown as diamonds 22 (FIG. 2) and as wavy or zig-zag patterns 24 (FIG. 3 and FIG. 4) in adhesive coating 16 on upper or adhesive surface 12 of membrane 10. As with the puddles 18 in FIG. 1, the diamonds 22 and waves 24 in FIGS. 2 and 3 respectively also allow membrane 10 to be adhered to a roof surface while providing for the use of significantly less coating 16. Other embodiments contemplated by the present invention included a variety of patterns formed in coating 16 such as checker board, criss-crossed, cross-hatched, overlapping zig-zag path and overlapping spiral puddles in both machine and cross-machine directions. The present invention is not limited to the configuration of the puddles discussed as an example here, but contemplates any and all patterns that result in discontinuous paths for rain water or precipitation and is directed to significantly reducing the amount of adhesive needed to coat membrane. The patterns in coating 16 may be random or non-random (periodic) or a combination of the patterns.

Patterns such as puddles 18, diamonds 22 and waves 24, as well as all other patterns in coating 16 that are contemplated by the present invention are generally formed by starving the feed of coating 16 as it is layered, cast, extruded, sprayed or dispersed upon lower or substrate surface 14.

Patterns such as puddles 18, diamonds 22 and wavy channels 24 in coating 16 may be formed in a variety of ways and this invention is not limited with respect to the manner of creating the patterns in coating 16. The patterns may be formed in coating 16 such as by roll coating, knife over roll coating, reverse roll coating, slot die coating, fiberizing the adhesive, rotating patterned-cylinder over slot die or extrusion device, or a combination of these methods.

Depending upon the type of pattern formed in coating 16 on membrane 10, the method in accordance with the present invention, as well as the peel-and-stick final product formed from the method is contemplated to utilize approximately 5-80% less adhesive on membrane 10 for comparable thickness relative to a fully coated membrane product, depending upon the adhesive quality and patterns 2 formed on membrane 10.

Exemplary adhesives for coating on membrane 10 include, but are not limited to asphaltic and modified bituminous compounds commonly used in roofing products, polyisobutenes (PIB), polybutenes, polyisoprene, butyl rubber, styrene-isoprene-styrene (SIS), styrene-butadiene-styrene (SBS), styrene-ethylene-butadiene-styrene (SEBS), acrylics, polyurethanes, atactic polypropylene (APP) or suitable mixtures and blends thereof.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for preparing a partially coated roofing membrane, the method comprising the steps of:

a. feeding a layer of adhesive onto a membrane to provide a coating; and b. starving the feeding of the coating on the membrane so as to utilize less coating to provide a partially coated membrane having a continuous coating around its outer edge, discontinuous channels or configurations for water or precipitation along its surface that do not touch its outer edge, comparable thickness to a fully coated membrane and which provides water tight sealing of the membrane to a roofing surface.

2. The method of claim 1, wherein said feeding step comprises coating, spraying, casting, extruding, dispensing or spreading said layer of adhesive onto the membrane.

3. The method of claim 1, wherein said discontinuous channels are random or non-random.

4. The method of claim 1, wherein the adhesive is an asphaltic or nonasphaltic glue.

5. The method of claim 1, wherein the adhesive is fed onto the membrane by a feeding method selected from the group consisting of: roll coating, knife over roll coating, reverse roll coating, extrusion coating such as using a slot die, fiberizing the adhesive, casting, rotating patterned-cylinder over extrusion, screen coating, stencil spraying, or a combination of these methods.

6. The method of claim 1, wherein the feeding is starved such that less adhesive is coated on the membrane relative to a fully coated membrane of similar thickness of coating.

7. The method of claim 6, wherein the feeding is starved by creating puddles or starving the adhesive in a number of areas on the membrane so as to reduce the amount of adhesive layered on the membrane.

8. The method of claim 1, wherein the starved adhesive results from the formation of random or non-random patterns formed in the coating on the membrane surface.

9. The membrane of claim 1, wherein the membrane formed uses approximately 5-80% less adhesive for comparable thickness relative to a fully coated membrane.

* * * * *